US005950384A

United States Patent [19]

Aarness

[11] Patent Number: 5,950,384

[45] Date of Patent: Sep. 14, 1999

[54] LOUVERED VENT

[76] Inventor: James C. Aarness, 3848 Capsule Dr., Las Vegas, Nev. 89115

[21] Appl. No.: 08/946,808

[22] Filed: Oct. 8, 1997

Related U.S. Application Data

[60] Provisional application No. 60/027,961, Oct. 8, 1996.

[51] Int. Cl.[6] ..... E06B 7/08

[52] U.S. Cl. ..... 52/473; 52/202; 52/656.7; 52/220; 454/277

[58] Field of Search ..... 52/473, 302, 58, 52/198, 202, 656.7, 454, 220.8; 454/275, 277, 281, 283, 276; 160/89

[56] References Cited

U.S. PATENT DOCUMENTS

| | | |
|---|---|---|
| 312,585 | 2/1885 | Seton et al. . |
| 1,657,625 | 1/1928 | Hoal . |
| 2,356,325 | 8/1944 | Larsen . |
| 2,557,502 | 6/1951 | Goettl . |
| 2,835,001 | 5/1958 | Matthews . |
| 2,862,439 | 12/1958 | Arbetman . |
| 3,087,412 | 4/1963 | Holmes . |
| 3,120,036 | 2/1964 | Minds, Jr. . |
| 3,267,834 | 8/1966 | Hockett . |
| 3,339,330 | 9/1967 | Minds, Jr. . |
| 3,422,744 | 1/1969 | Tarnoff . |
| 3,645,195 | 2/1972 | Koval . |
| 3,771,430 | 11/1973 | Lane . |
| 5,254,034 | 10/1993 | Roth . |

*Primary Examiner*—Carl D. Friedman
*Assistant Examiner*—Winie S. Yip
*Attorney, Agent, or Firm*—Kenehan Lambertsen & Stein; John C. Lambertsen

[57] ABSTRACT

A sheet metal ventilation louver is fabricated out of two types of blades, a center and a top/bottom blade, that are shaped in a manner that permits their slidable engagement with an outer support frame. The side panels making up the outer frame are fabricated out of sheet metal rectangles that have been bent, with slots formed in the bent areas at locations enabling the slidable receipt of the blades within the side panel slots. An outer frame then fits around the side panels, retaining both the side panels and their received blades in position, completing the ventilation louver.

4 Claims, 2 Drawing Sheets

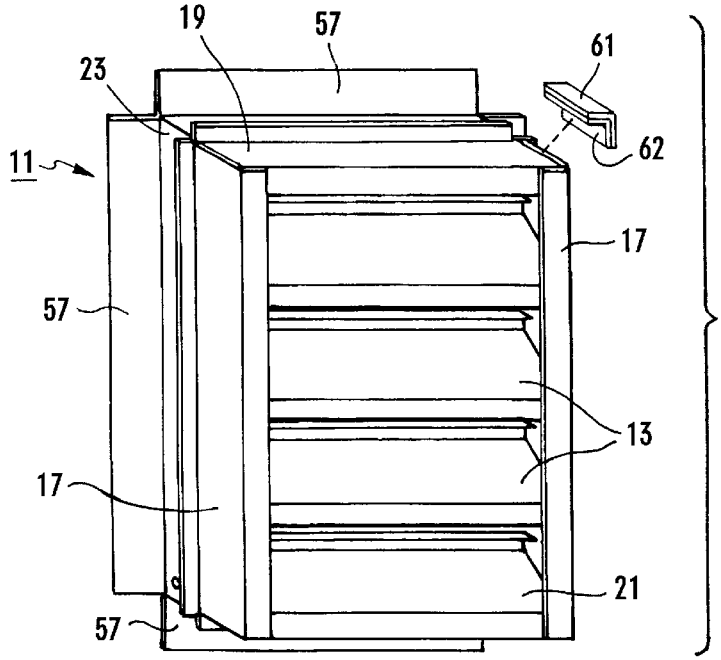
Fig. 1
Fig. 3A
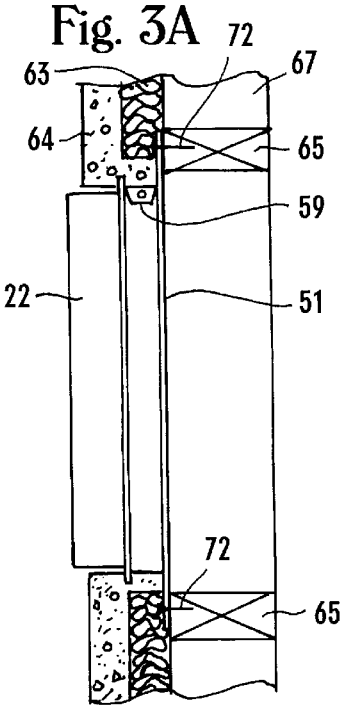
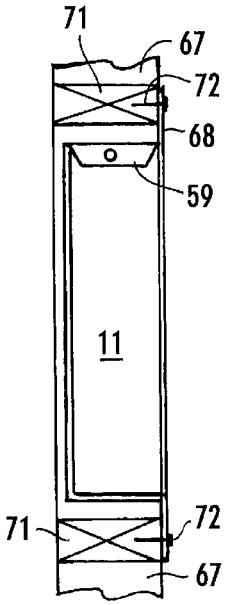
Fig. 3B
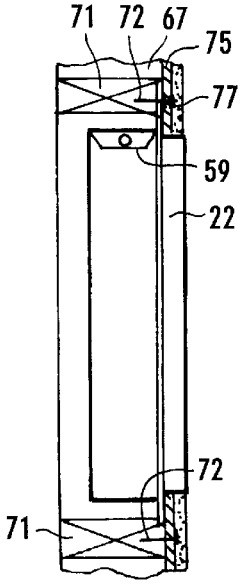
Fig. 3C
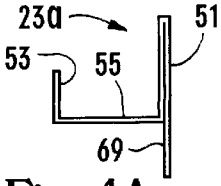
Fig. 4A
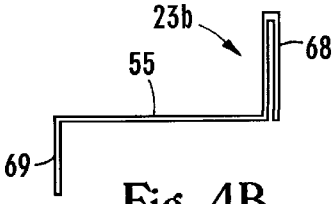
Fig. 4B
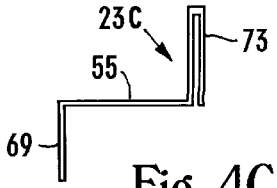
Fig. 4C

LOUVERED VENT

CROSS-REFERENCE TO RELATED APPLICATION

This application claims the benefit of U.S. Provisional Application No. 60/027,961, filed Oct. 8, 1996.

BACKGROUND OF THE INVENTION

1. Field of the Invention

The present invention relates to ventilators and louvers for use in ventilating buildings, and more particularly to such devices as have a plurality of louver blades secured within an outer frame. More specifically, the present invention relates to a multi-bladed louver that is designed and constructed to be readily assembled, from component parts without the use of welding.

2. Description of the Prior Art

Louvers have long been used in association with air handling and ventilation equipment to permit the intake and exhaust of air from buildings. Conventionally, louvers have comprised a plurality of metal louver blades secured within an outer metal frame of generally rectangular shape. Louvers normally range in size from eighteen inches up to forty-eight inches in height, with similar ranges in width.

The attachment of the louver blades to the outer support frame traditionally has been accomplished by using such fasteners as nails, rivets or screws. More recently the lower blades have been individually attached to the outer frame by spot welding. Fabrication of the louvered vents begins with a galvanized metal sheet that is cut into a variety of blade patterns. Each blade is further provided with a variety of slots and projections, permitting the various component parts to be fit together.

In addition to the tedium of making all of these exacting fabrication cuts, the one-by-one attachment of each member to the frame requires one or more spot welds to retain that member in place. Spot welding not only requires expensive equipment and further processing steps, the intense heating required also affects the ability of the galvanized metal to resist corrosion.

A variety of louver fabrication techniques are suggested in the prior art towards limiting the amount of fastening steps required to secure the louvers to the outer frame. The use of tabs formed in the outer frames is suggested by Minds, Jr., U.S. Pat. No. 3,339,330, with the tab spacing somewhat less than the louver width, resulting in the biasing force exerted against the tabs by the louvers intended to secure and maintain the louvers in position. In Roth, U.S. Pat. No. 5,254,034, the louver blade consists of two blade members slidably engaged with one-another, with screws used to attached each of the blades to a respective frame member.

The ventilating louver of Tarnoff, U.S. Pat. No. 3,422,744, makes use of projecting longitudinal supports formed in the outer frame, with the louvers received within spaced-apart slots that are formed in the supports. The slots are staggered between the fore and aft supports, permitting a flat louver inserted within the slots to obtain a desired, slanted orientation within the frame.

Ideally, a ventilation louver would be constructed out of easily-formed pieces of sheet metal that, when brought together, form an interlocking construction requiring few if any fasteners or welding operations to complete a finished unit.

SUMMARY OF THE INVENTION

It is an object of the present invention to provide a ventilation louver that is fabricated in a far different manner than the traditional sheet metal louver. Instead of requiring the sheet metal cutting of a variety blade patterns that include tabs and slots, the present invention requires only two types of blades—center and top/bottom. Additionally, all cuts of the present, inventive blade are "end cuts" (straight across), with the blades then bent to a shape suitable for meshing with the outer frames.

The side panels making up the outer frame are likewise simple in construction, beginning with simple sheet metal rectangles. The longitudinal edges are then bent, and a series of spaced-apart double slots are formed to receive the bent edges of the blades. The cuts in the side panels and the bends in the blades are made to allow the blades to slide into the side panel slots, which in turn will position the blades. The opposite side panel is then slid onto the opposite blade edges, resulting in a somewhat stable framed louver construction.

The vent is completed by laying a screen material over the completed vent and side panels, and then an outer, sheet metal frame is placed over and around the vent and side panels. In fact, it is the outer frame that retains in place the completed side panels and inner blades construction. For the larger vents, the outer frame is preferably fabricated in two pieces, that are then attached together using either spot welding (preferably) or with two screws. The smaller frames can be "preconstructed" and are preferably retained together by one or two spot welds.

Some further objects and advantages of the present invention shall become apparent from the ensuing description and as illustrated in the accompanying drawings.

BRIEF DESCRIPTION OF THE DRAWINGS

FIG. 1 is a perspective view showing a fully fabricated louvered vent in accordance with the present invention;

FIGS. 3A–3C are partial elevation views with portions in cross section, showing three alternative outer frame styles of the louvered vent as installed in an outer wall of a building in accordance with the present invention; and FIGS. 4A–4C are side elevation views showing in profile, alternative frames for use in the louvered vent in accordance with the present invention.

DETAILED DESCRIPTION OF THE PREFERRED EMBODIMENTS

Figure 2:
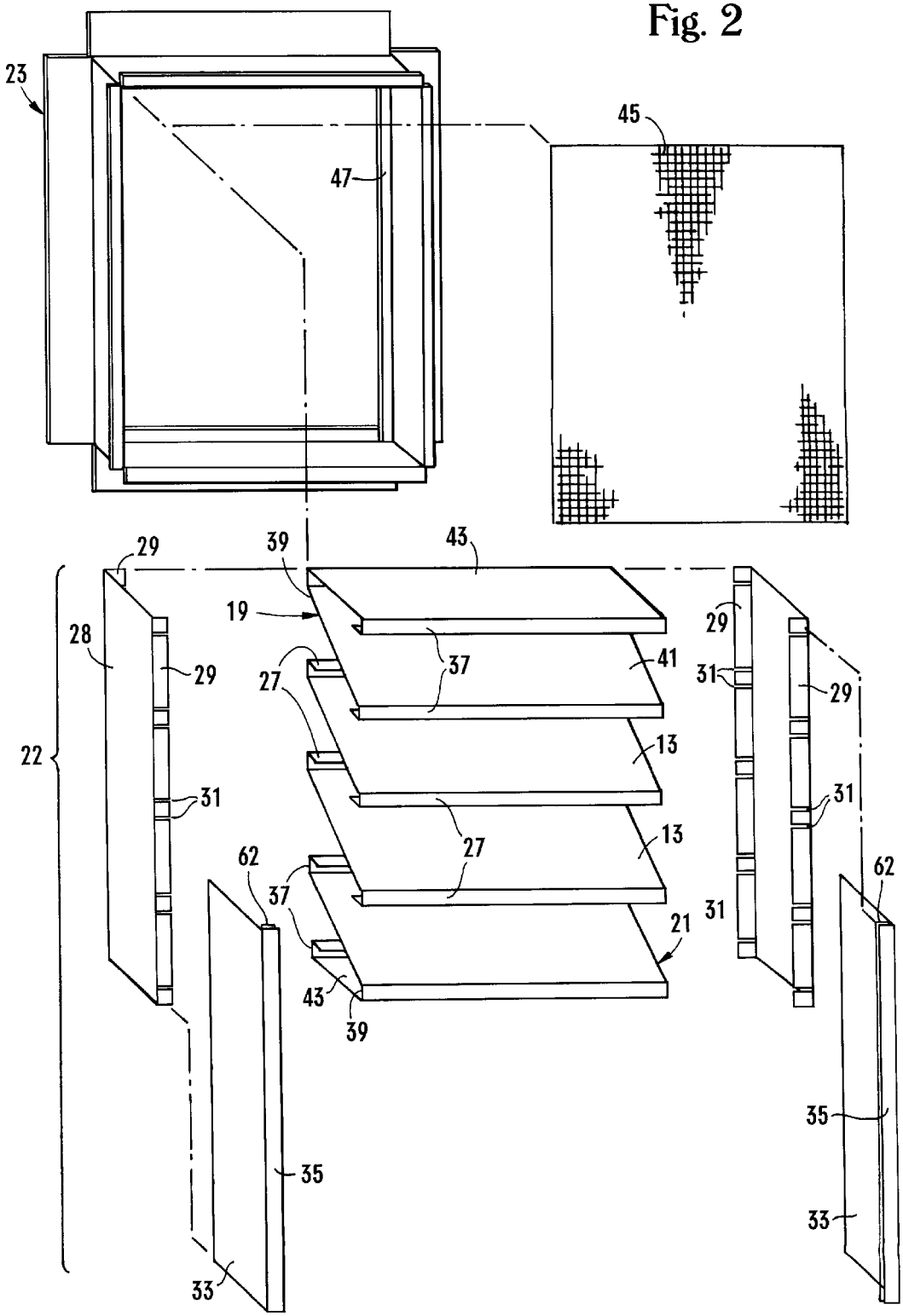
FIG. 2 is an exploded, perspective view showing the individual component parts of the louvered vent in accordance with the present invention.

Reference is now made to the drawings wherein like numerals refer to like parts throughout. A louvered vent 11 is shown in FIG. 1 having a plurality of blades 13. A pair of side panels 17 along with an upper blade 19 and a lower blade 21 form an inner framework that surround and support the plurality of blades 13, together forming a louver panel 22 (best shown in FIG. 2). The louver panel 22 is in turn received and secured within an outer frame 23.

Turning now to FIG. 2, the individual component parts that comprise the louvered vents 11 are arranged in a manner that illustrates both their individual fabrication and their cooperative placement to form the louvered vent: construction. Turning first to the blades 13, each are identically fabricated out of rectangular sheets of metal that are cut into individual pieces of identical length. Both longitudinal edges are then crimped to form a pair of blade flanges 27 located on opposite sides of the blade 13.

The side panels 17 in fact preferably consist of a double structure construction, the first being a pair of side rails 28.

In a similar manner to the fabrication of the blades 13, the side rails 28 are fabricated out of a stock material that consists of a rectangular metal sheet, with both longitudinal edges crimped to form a pair of blade-receiving projections 29 located on one side of the side rail 28. A plurality of blade-receiving slots 31 are formed along the length of the projections 29 at distances that correspond to the desired spacing for the blades 13.

During assembly, the blade flanges 27 are received by the blade-receiving slots 31 formed in the projections 29 of the side rails 28. To prevent the blades from backing out of the slots 31 a pair of securement panels 33 are provided and, with the side rails 28, comprise the side panel construction 17. Also fabricated out of rectangular sheet metal stock, the securement panels 33 are then longitudinally crimped along a front edge to form a securement flap 35.

After all of the blades have been received within the blade-receiving slots 31 of the side rails 28, the blade panel is completed by the addition of the upper blade 19 and the lower blade 21. The same blade construction is used for both the upper and lower blades 19, 21 with the only difference being the orientation of its attachment to the side rails 28.

The upper and lower blades 19, 21 are formed out of a rectangular piece of sheet metal stock with a series of crimping operations that form a pair of crimped flanges 37 that are separated by a longitudinal obtuse crimp 39. As so constructed, the obtuse crimp 39 separates the upper and lower blades 19, 21 into a blade surface 41 and base surface 43. The blade surface 41 is substantially identical in size and angle relationship to the individual blades 13.

The crimped flanges 37 and the obtuse crimp 39 are dimensioned such that they are received by appropriately positioned blade-receiving slots 31 formed in the side rail 28. When so received, the base surface 43 forms the upper and lower lateral surfaces of the inner frame of the louver panel 22.

The securement panels 33 are then placed over and attached to the side rails 28. The securement flap 35 is received against the blade-receiving projections 29 and prevents the individual blades from backing out of the blade receiving slots 31. The securement panels 33 thus significantly increased the integrity of the connection between the side rails 28 and the blade components.

Completion of the louvered vent 11 then requires insertion of the inner frame of the louver panel 22 into the outer frame 23. Prior to such insertion a screen 45 is preferably received within the outer frame 23 and is held in place between the louver panel 22 and a receiving frame 47 formed within the outer frame 23.

Fabrication of the outer frame 23 proceeds in a manner similar to that for the blades 13, the upper and lower blades 19, 21, and the securement panels 33. A rectangular piece of sheet metal stock is subjected to crimping, cutting, and bending to form the rectangular outer frame 23. This process is best explained by reference to FIGS. 3 and 4.

As is depicted in FIGS. 4A–4C, three different types of outer frames 23 are provided, with the selection dependent upon the manner in which the louvered vent 11 will be mounted in the wall of a building. In the outer frame 23*a* of FIG. 4A, the sheet metal stock is first crimped to form an anchoring flange 51. A second crimp is made along a longitudinal edge of the sheet metal stock to form an inner flange 53 that is separated from the anchoring flange 51 by a planer frame section 55. A portion of the anchoring flange 51 projects beyond the plane containing the planer frame section 55, with this projecting portion forming a receiving frame 47 when the outer frame 23 has been assembled.

Assembly of the outer frame 23*a* first requires that a cut be made into the anchoring flange 51 to a depth that is substantially co-planer with the planer frame section 55. Three additional such cuts are made into the anchoring flange 51, spaced apart from one another by distances corresponding to the height and width of the desired outer frame 23. After completion of the various cuts made into the anchoring flange 51, the planer frame section is bent into substantially a ninety degree angle at each of such cuts, forming a rectangularly-shaped outer frame 23. Such cuts and bending operations result in the formation of a series of four individual outer flange sections 57 (see FIG. 1).

Returning now to FIG. 3A, the four outer frame sections are retained together by a securement tab 59 formed at the terminus of the fourth panel section. The securement tab 59 is then bent to conform with the outer frame cover and is thereafter attached to the planer frame section 55 of the first panel section. Securement can be obtained through using fasteners such as metal screws or rivets, or as a result of spot welding.

Alternatively, as is depicted in FIG. 1, a connecting angle 61 can be used to attach the fourth frame panel section to the first panel section. The connecting angle 61 is sized to be received by the corner formed at the intersection of the fourth and the first panel sections. An adhesive layer 62 is provided on an inside surface of the connecting angle 61 and causes the connecting angle 61 to become attached to both intersecting panel members. In this manner, the first and the fourth panel members are attached to one another, forming a corner defined in shape and angle by the connecting angle 61.

The frame depicted in FIGS. 3A and 4A is known as a "Flat on Back" frame ("FOB") and is employed where the insulation for the building is located on the outside of the framing, and continuity of such insulation layer requires the placement of an insulation panel 63, such as Styrofoam, around the louvered vent installation, and a covering layer of stucco 64. This permits the blending of the louvered vent installation with the surrounding outer wall surface. The anchoring flange 51 rests against and is attached to an existing internal frame member 65 located within an outer wall 67—no special framing is required. As mentioned previously, the screen 45 is located on the building side and rests between the retention flange 69 (part of the receiving frame 47) and the louver panel 22 (see FIG. 4A).

In the outer frame 23*b* of FIG. 4B, fabrication of the sheet metal stock proceeds with a crimping operation that forms a border flange 68 and a rear, retention flange 69. The outer framework is once again constructed as previously discussed utilizing a plurality of measured cuts and bending operations. The outer frame 23*b* depicted in FIG. 4B is utilized in a construction installation known as a "Flat on Face" installation ("FOC") wherein the border flange 68 rests upon and is attached to an exposed framing member 71 of the outer wall 67 using a plurality of fasteners 72 (also shown in FIG. 3B).

The installation of FIG. 3B results in the louvered vent 11 lying flush against the outside surface of the outer wall 67. The border flange 68 retains the louver panel within the outer wall 67 as well as the screen 45 that is positioned between the louver panel 22 and the retention flange 69.

The outer frame depicted in FIG. 4C is somewhat similar in fabrication to that of the "Flat on Face" configuration of FIGS. 3B and 4B. However, the initial sheet metal stock is shorter in width, with a resultant shortening in the dimensions of the planer frame section 55. An initial crimp results in the creation of a sealing flange 73 that is dimensionally similar to the border flange 68, with a similar crimp resulting in the retention flange 69.

The outer frame 23*c* depicted in FIG. 4C is known as the "Plaster Ground" installation. As shown in FIG. 3C, the shortened length of the planer frame section 55 results in the sealing flange 73 lying flush with the outer wall 67 and the louver panel 22 projecting outwardly from the sealing flange 73. The "Plaster Ground" outer frame 23*c* is used when the building insulation is located within the wall structure, and a special structural frame is constructed to receive the louvered vent 11 within the wall. The retention flange 69 once again receives the screen 45 and the louver panel 22. Once the louvered vent 11 has been placed within the outer wall 67, a sheet of building paper 75 is placed underneath the sealing flange 73 and extends outwardly into the surrounding outer wall 67. The louvered vent installation is then completed by the application of a layer of plaster or stucco 77, known as a "brown coat", that is placed over the insulation panel 75 and blended in with the outer wall surface surrounding the louvered vent 11.

As received within the outer frame, the louver panel 22 obtains a good deal of structural support from the surrounding outer frame 23. It is preferred that the louver panel be attached to the outer frame 23, and when using the attachment tab 59 with a screw fastener, a sufficiently long screw can be used to pierce both the outer frame member as well as the securement panels 33 and the side rail 28. In such a manner, the louver panel is secured to the outer frame 23. When the connecting angle 61 is used to attach the outer frame members together, separate metal screws can optionally be utilized to connect the outer frame members with the securement panel 33 and the side rail member 28 of the louver panel.

A preferred metal sheet form material for fabricating the various component parts of the louvered vent 11 is 28 gauge galvanized iron. As discussed previously, the plurality of blades 13 and the upper and lower blades 19, 21 are preferably attached to the side rails 28 by being received within the blade-receiving slots 31 formed in the blade-receiving projections 29 of the side rails 28.

The securement flaps 35 are preferably attached to the side rails 28 by a layer of an adhesive, such as the adhesive layer 62 in FIG. 2, formed on the inner surface of the securement panel 33, with a polyethylene gasket material having an adhesive backing (of the type that: is presently used in the construction trade for access door installation and in the installation of ductwork) being presently preferred. Alternatively, the securement panels 33 can be attached to the side rails 28 utilizing a variety of conventional fasteners, including metal screws and rivets, as well as by spot welding.

The outer frame 23 can be held together utilizing the fastener and attachment tab 59 previously discussed, or, optionally, the connecting angle 61 as is shown in FIG. 1. In a manner similar to the attachment tab 59, the adhesive layer 62 is applied to an inside surface of the connecting angle 61 and attaches the first section of the outer frame to the fourth section of the outer frame. An adhesive polyethylene gasket of the type previously discussed is appropriate for forming the adhesive layer 61.

For dimensions equal to or smaller than 48 inches in length and 48 inches in height, the outer frame can consist of a single section with three ninety degree bends forming the individual outer frame sections, as has been previously discussed. However, for outer frames to be used with larger louvered vents, it is preferred that the outer frames consist of two separate pieces, with a single bend in each. In such instances, there are two attachment locations to connect the two outer frame members (not shown in the Figures) and either the tab/fastener method or the connecting angle member/adhesive method are appropriate for connecting the separate outer frame components together.

My invention has been disclosed in terms of a preferred embodiment thereof, which provides an improved louvered panel that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A louver comprising:

an outer frame; and a louver panel received within and enframed by said outer frame, said louver panel comprising:

a pair of opposing side rails, each of said side rails having projecting flanges extending along opposite longitudinal edges of said side rail, with each of said projecting flanges having a plurality of blade-receiving slots formed therein at a plurality of longitudinally-spaced locations along said projecting flanges;

at least one louver blade extending between said pair of opposing side rails and slidably received by such of said blade-receiving slots as are located on each of said side rails at a substantially similar longitudinal location along each of the respective projecting flanges;

a pair of end blades, each extending between said pair of opposing side rails, a first of said pair of end blades slidably received by such of said blade receiving slots as are located at an initial longitudinal location on said projecting flanges and a second of said pair of end blades slidably received by such of said blade receiving slots as are located at a terminal longitudinal location on said projecting flanges; and a pair of securement panels, each having a securement flange formed along a first longitudinal edge thereof, said securement flange of each of said pair of securement panels attached to a separate one of said pair of opposing side rails on an opposing pair of projecting flanges thereof, the attachment of said securement flanges to said projecting flanges covering said blade-receiving slots and securing said at least one louver blade and said pair of end blades as are received in said projecting flanges.

2. A louver as described in claim 1, wherein said plurality of blade receiving slots comprise an initial single slot, a terminal single slot, and at least one intermediate pair of double slots, and wherein each of said louver blades have at least one longitudinal crimps formed between opposite longitudinal edges, said at least one longitudinal crimps forming a pair blade flanges at said opposite longitudinal edges and having latitudinal widths substantially identical to a longitudinal distance of separation between said intermediate pair of double slots, whereby said blade flange is slidably received by said pair of double slots and said louver blades are slidably received by said blade receiving slots.

3. A louver as described in claim 2, wherein each of said pair of end blades have a longitudinal pair of crimps formed thereof along each longitudinal edge thereof and along a central location spaced from said longitudinal edges, the longitudinal edge of each said pair of crimps forming a crimp flange and the central location of said pair of crimps forming an obtuse flange, both of latitudinal width of said crimp flange and obtuse flange substantially identical to said longitudinal distance of separation between said intermediate pair of double slots and a longitudinal distance of separation as exists between both said initial single slot and said terminal single slot and a respective adjacent terminus of said side rail, whereby each of said end blades is slidably received by each of said side rails, with one of said crimp flanges and the obtuse flange received by the single slots and the other of said crimp flanges received by one of the double slots.

4. A louver comprising:

an outer frame; and a louver panel received within and enframed by said outer frame, said louver panel comprising:

a pair of opposing side rails, each of said side rails having projecting flanges extending along opposite longitudinal edges of said side rail, with each of said projecting flanges having a plurality of blade-receiving slots formed therein at a plurality of longitudinally-spaced locations along said projecting flanges, wherein said plurality of blade receiving slots comprise an initial single slot, a terminal single slot, and at least one intermediate pair of double slots, at least one louver blade extending between said pair of opposing side rails and slidably received by such of said blade-receiving intermediate pare of double slots as are located on each of said side rails at a substantially similar longitudinal location along each of the respective projecting flanges;

a pair of end blades, each extending between said pair of opposing side rails, a first of said pair of end blades slidably received by such of said blade receiving initial single slots as are located at an initial longitudinal location on said projecting flanges and a second of said pair of end blades slidably received by such of said blade receiving terminal single slots as are located at a terminal longitudinal location on said projecting flanges, wherein each of said pair of end blades have a longitudinal pair of crimps formed along each longitudinal edge and along a central location spaced from said longitudinal edges, the longitudinal edge of each said pair of crimps forming a crimp flange and the central location of said pair of crimps forming an obtuse flange, both of latitudinal width of said crimp flanges and obtuse flanges substantially identical to said longitudinal distance of separation between said intermediate pair of double slots and a longitudinal distance of separation as exists between both said initial single slot and said terminal single slot and a respective adjacent terminus of said side rail; and a pair of securement panels, each having a securement flange formed along a first longitudinal edge thereof, said securement flange of each of said pair of securement panels attached to a separate one of said pair of opposing side rails on an opposing pair of projecting flanges thereof, the attachment of said securement flanges to said projecting flanges securing said at least one louver blade and said pair of end blades as are received therein, wherein said securement flanges attach to such portions of said blade flanges, said crimp flanges, and said obtuse flanges as are received by said projecting flanges of said pair of opposing side rails when said lower blades and said end blades are slidably received upon said pair of opposing side rails.

* * * * *